United States Patent [19]

Chiboroski

[11] 4,195,213

[45] Mar. 25, 1980

[54] FEEDING MECHANISM FOR INDUCTION HEATING COIL

[75] Inventor: Joseph W. Chiboroski, Brooklyn Heights, Ohio

[73] Assignee: Park-Ohio Industries, Inc., Cleveland, Ohio

[21] Appl. No.: 883,648

[22] Filed: Mar. 6, 1978

[51] Int. Cl.[2] ..... H05B 5/18

[52] U.S. Cl. ..... 219/10.69; 219/10.73; 198/774

[58] Field of Search ..... 219/10.69, 10.67, 10.71, 219/10.73; 214/18 R, 18.34, 23, 26, 29, 32, 33, 34; 198/750, 772, 773, 774, 775, 776, 777

[56] References Cited

U.S. PATENT DOCUMENTS

| | | | |
|---|---|---|---|
| 2,684,769 | 7/1954 | Wallerius | 198/773 |
| 3,057,986 | 10/1962 | Armstrong et al. | 219/10.69 |
| 3,089,687 | 5/1963 | Peck | 198/774 |
| 3,149,581 | 9/1964 | Davis | 198/750 |

FOREIGN PATENT DOCUMENTS

| | | | |
|---|---|---|---|
| 964439 | 7/1964 | United Kingdom | 219/10.69 |
| 1021961 | 3/1966 | United Kingdom | 219/10.69 |

*Primary Examiner*—Bruce A. Reynolds
*Assistant Examiner*—Philip H. Leung
*Attorney, Agent, or Firm*—Meyer, Tilberry & Body

[57] ABSTRACT

Feeding means for successively advancing elongated workpieces step-by-step, through the central workpiece receiving passage in a multiturn induction heating coil with a workpiece supporting slide track extending therethrough, has an elongated workpiece pusher member extending longitudinally through the passage and provided with workpiece engaging driving lugs spaced therealong. Combined transport and elevating means reciprocate the pusher member axially of the passage between a retracted and an extended position to advance the workpiece into and subsequently out of the heating coil passage and shift the pusher member between two different elevational positions in which its driving lugs are respectively located in the path of travel of the workpiece along the slide track during the advance stroke of the pusher member and out of the path of travel during the return stroke of the pusher member. The transport and elevating means has reciprocable actuating rod means which carries and reciprocates the pusher member and also carries a plurality of pivoted throw arms which pivot between declined and upright positions, at the outset of the advance and return strokes of the actuating rod means, to shift the pusher member between its two different elevational positions.

21 Claims, 9 Drawing Figures

FEEDING MECHANISM FOR INDUCTION HEATING COIL

BACKGROUND OF THE INVENTION

The present invention relates to the art of induction heating and more particularly to an apparatus for conveying elongated workpieces through a multiturn induction heating coil.

The invention is particularly applicable for heating forging billets to a forging temperature and it will be described with reference thereto; however, the invention has broader applications and may be used in various installations for inductively heating a succession of workpieces passing through an induction heating coil.

It is common practice to inductively heat elongated workpieces, such as billets to be forged, by passing the workpieces axially through an elongated passageway surrounded by a multiturn induction heating coil. A substantial amount of effort has been devoted to arrangements for conveying the workpiece itself through the passage. The most common arrangement is to provide spaced support rails or elements extending through the passage of the heating coil and a pusher rod for pushing a line of abutting workpieces along the support rails and axially through the passage wherein they are heated by energizing the induction heating coil. Several prior patents show this feature; however, one representative patent of this concept is Armstrong U.S. Pat. No. 3,057,986 which is incorporated by reference herein as background information. This pusher rod concept requires contact between adjacent workpieces moving and pushing one another through the central passage. This contact can cause certain difficulty with respect to uneven heating at the abutting surfaces between adjacent workpieces, in particular, by the contacting and cooling of the rearward end of a workpiece being heated in the heating coil by a cold workpiece being initially fed into the coil. The abutting of the workpieces against one another, such as required in the prior pusher rod arrangements, also can produce the problem of adjacent workpieces sticking together.

To overcome the major disadvantages of the prior conventional pusher rod arrangements, so-called walking beam type feeder arrangements have been provided for conveying workpieces through the central passage of the multiturn induction heating coil or coils. These walking beam arrangements generally include fixed workpiece support rails in the coil passage similar to the rails along which the workpieces are pushed in the conventional pusher rod type feeder arrangements. Then, a second set of rails is provided below the support rails and extending through the coil passage. These second rails are moved in both a vertical and longitudinal direction. By moving the second set of rails vertically upward, the workpieces are lifted in unison off the support rails where they then can be moved in a forward direction in the passage by longitudinal advance movement of the transfer or second set of rails. Thereafter, the transfer rails are shifted into a downward position which then deposits the workpieces back onto the support rails passing through the coil passage. The moving or transfer rails are then retracted and the cycle is repeated. In this manner, the workpieces can be progressively moved through the passageway of the induction heating coil for heating without requiring them to be abutted against, and in contact with one another as in the prior conventional pusher rod feeder arrangements.

This then eliminates the disadvantages referred to above that are created by such contacting of the workpieces with one another. Various patents such as British Pat. No. 1,021,961 and British Pat. No. 964,439 incorporated by reference herein for background information disclose forms of such walking beam type feeder arrangements. However, all these walking beam feeder arrangements include a substantial amount of mass within the heating coil that normally affects the heating of the workpieces. In addition, because they require the lifting of the workpieces off the support rails by the transfer rails, and the movement of the workpieces through the heating coil passage while thus carried by the transfer rails, these walking beam type feeder arrangements normally require considerably more power to operate than the prior conventional pusher rod feeder arrangements, thus adding to the operating cost. Also, the walking beam or movable transfer rail concept generally involves an arrangement for cooling the moving rails along with the fixed support rails. These cooled rails, besides producing undesired cooler sections on the workpiece surfaces, cause substantial difficulty in producing fluid flow through rails which are movable both vertically and longitudinally.

SUMMARY OF THE INVENTION

The present invention contemplates new and improved apparatus which overcomes all of the above referred to problems and others and provides a workpiece feeder arrangement, for progressively moving the workpieces through the passageway of an induction heating coil or coils, which is of simple construction and economical to operate.

In accordance with the present invention, there is provided a workpiece feeder arrangement of the pusher rod type for moving workpieces through the passage of an induction heating coil or coils wherein the pusher rod is in the form of an elongated reciprocable driven member guided within and extending axially through the passage. The pusher rod is equipped with drive lugs or abutment shoulders for engaging the workpieces to push them in step-by-step fashion and in spaced end-to-end relation along the slide track and through the heating coil passage as the push rod is alternately advanced and retracted within the passage by a transfer means which reciprocates the pusher rod alternately between a first retracted position and a second advanced or extended position. Elevating means are provided to shift the pusher rod between a first elevational position in which the drive lugs are out of the path of sliding movement of the workpieces along the support track to a second elevational position in which the drive lugs are in that path. The elevating means includes a power driven reciprocable actuating rod means for shifting the pusher rod from its first to its second or workpiece engaging elevational position at the outset of the advance stroke of the actuating rod means and similarly shifting the pusher rod back to its second or workpiece disengaged elevational position at the outset of the return stroke of the actuating rod means. The drive lugs on the pusher rod are spaced apart therealong a distance exceeding the length of the workpieces so that the latter are maintained out of end-to-end abutting contact with one another as they are advanced along the slide track and through the induction heating coil passage, thereby avoiding uneven heating of the workpieces at their ends as well as preventing their sticking together. The pusher rod feeder arrangement of the present invention thus affords the same advantages of even heating, and non-sticking together of the workpieces, as have been provided heretofore by walking beam type workpiece feeder arrangements but without requiring the comparatively high operating power requirements of such walking beam arrangements occasioned by the necessity of lifting the workpieces in such arrangements off their fixed support rails and carrying them to their advanced position. Also, the invention requires less components than the walking beam units.

In accordance with a further aspect of the invention, the elevating means is preferably constituted as a part of and is actuated by the transfer means. Thus, the same power drive means can be utilized to actuate both the transfer and the elevating means, thereby simplifying the construction of the apparatus and reducing the power required for its operation.

In accordance with a still further aspect of the invention, the actuating rod means for reciprocating the pusher rod is connected thereto through a lost motion connection which provides a limited amount of lost motion travel of the actuating rod means relative to the pusher rod at the very outset of both its advance and return strokes and before it drivingly interconnects with the pusher rod to advance and retract it. This initial lost motion travel of the actuating rod means then actuates the elevating means to initially shift the pusher rod between its first and second elevational positions at the very outset of the advance and return strokes of the actuating rod means and before any advance or retraction movement of the pusher rod by the actuating rod means can take place.

According to yet another aspect of the invention, the elevating means for the pusher rod is constituted by a plurality of cam means or throw arms freely pivoted at one end on the actuating rod means at spaced points therealong and frictionally engaging at their free other ends with a roughened horizontal slide surface paralleling the pusher rod. On reciprocation of the actuating rod means, the frictional engagement of the throw arms with the roughened slide surface pivots them between a declined lower position and a substantially upright raised position, thus shifting the pusher rod between its first and second elevational positions.

It is the principal object of the invention to provide an improved pusher rod type feeding mechanism for advancing workpieces through the axially extending workpiece receiving passage of an induction heating coil or coils, which mechanism is of simple construction and is economical in operation.

Another object of the present invention is to provide a pusher rod type feeding mechanism as described above, which mechanism does not require abutting relationship between adjacent elongated workpieces as they are conveyed through the workpiece receiving passage of an induction heating coil.

Still another object of the present invention is to provide a pusher rod type feeding mechanism as described above and having a horizontally reciprocable workpiece pusher rod extending through the workpiece receiving passage of the induction heating coil and vertically shiftable between two different elevational positions respectively in and out of driving relation to the workpieces during its advance and return strokes.

A further object of the present invention is to provide a pusher rod type workpiece feeding mechanism as described above and having a workpiece pusher rod extending horizontally through the workpiece receiving passage of the induction heating coil and common actuating means for both reciprocating the pusher rod horizontally between retracted and advanced positions and shifting it vertically between two different elevational positions respectively in and out of driving relationship to the workpieces.

Further objects and advantages of the invention will appear from the following detailed description of a species thereof and from the accompanying drawings.

DESCRIPTION OF THE PREFERRED EMBODIMENT

Figure 1:
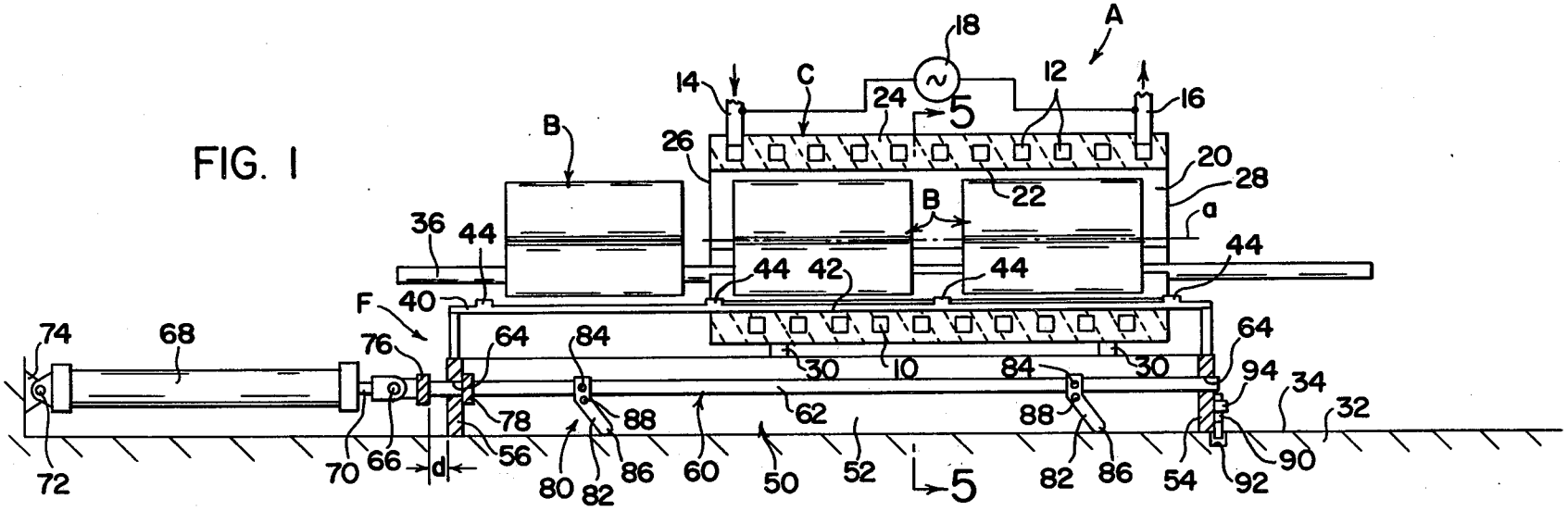
FIG. 1 is a side elevational view, partly in section, showing a preferred species of the feeder mechanism comprising the invention at the start of an operating cycle with the pusher rod shown in its lowered elevational position.

Referring now to the drawings wherein the showings are for the purpose of illustrating a preferred embodiment of the invention only and not for the purpose of limiting same, FIGS. 1–7 illustrate an induction heating device A constructed in accordance with the preferred embodiment of the present invention for heating elongated workpieces B which, in the illustrated embodiment, are in the form of steel billets having a generally square cross-sectional shape. Of course, other shapes could be heated by apparatus A. Workpieces B are progressively advanced in succession axially through apparatus A for inductively heating the workpieces to a desired elevational temperature in the general neighborhood of 1700° F.–2400° F. for subsequent processing, such as forging. Apparatus A includes one or more induction heating coil units C, only one such heating coil unit being shown in the illustrated embodiment.

Induction heating coil unit C includes a multiturn induction heating coil 10 formed from a hollow electrical conductor helically coiled in a plurality of convolutions 12 about a linear coil axis a and connected at its opposite ends to a coolant inlet 14 and a coolant outlet 16 forming spaced connector leads which are adapted to be connected across an appropriate A.C. power supply, schematically illustrated as a generator 18. The coil unit C is provided with an elongated central workpiece receiving passage 20 extending therethrough coincident with the central coil axis a and defined by a peripheral wall 22 formed from a refractory material 24 which encapsulates the coil turns or convolutions 12. Wall 22 is provided with a cross-sectional contour generally matching, at least throughout its lower half section as shown, the cross-sectional contour of the workpieces B to be processed; however, various other contours may be employed for the central workpiece receiving passage 20 in accordance with normal practice. Passage 20 includes an entrant end 26 and an exit end 28, and the workpieces B are progressively passed in succession through the passage 20 for inductive heating by multi-turn heating coil 10 as it is energized by the power source or generator 18. In the particular case illustrated, the heating coil unit C and its central workpiece receiving passage 20 are formed of sufficient length to accomodate two of the workpieces B in successive heating positions therein spaced end-to-end, into each of which heating positions each workpiece is successively advanced for heating thereof by the induction heating coil 10.

The coil unit 10 is supported in place, with its coil axis a extending horizontally, on a plurality of support legs 30 fastened to and upstanding from a support base 32. The support base is provided with a substantially flat horizontally disposed upper or slide surface 34 which underlies and extends a substantial distance beyond the opposite ends of the heating coil unit C.

Figure 2:
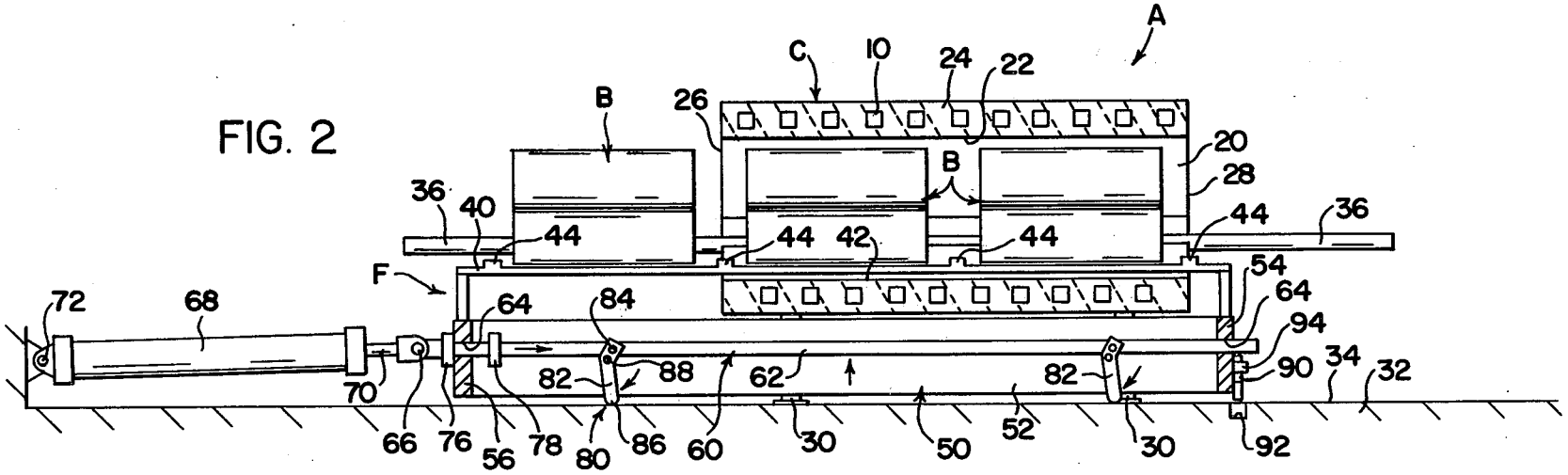
FIG. 2 is a view similar to FIG. 1 but showing instead the feeder mechanism at an intermediate stage in its feeding stroke with the pusher rod in its raised elevational position.
Figure 3:
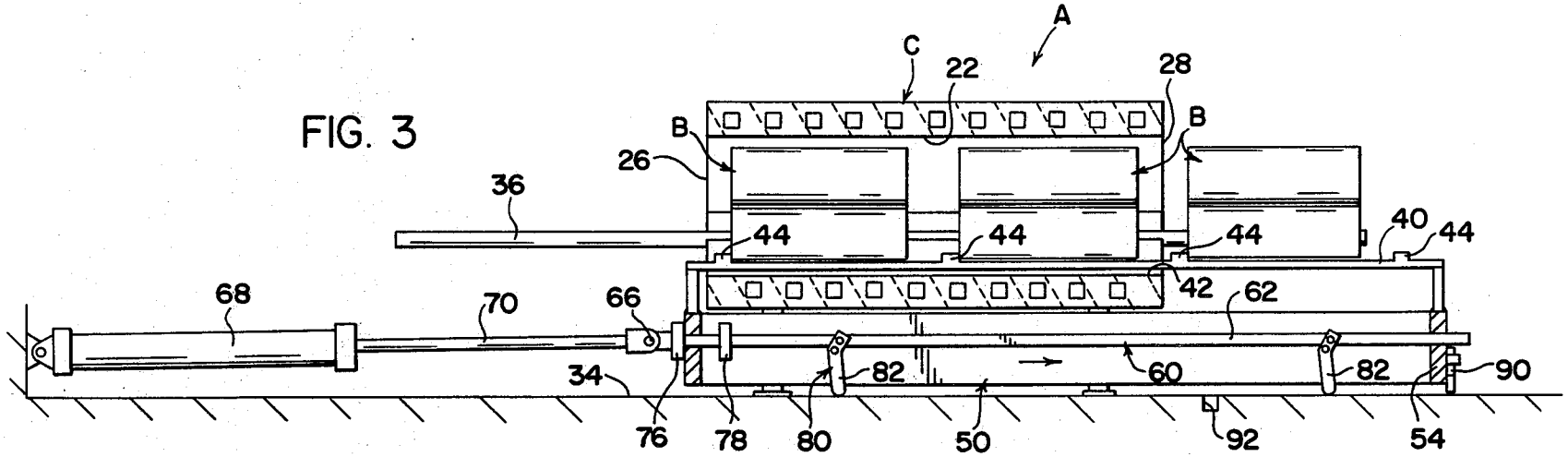
FIG. 3 is a view similar to FIG. 1 but showing instead the feeder mechanism at the end of its feeding stroke.
Figure 4:
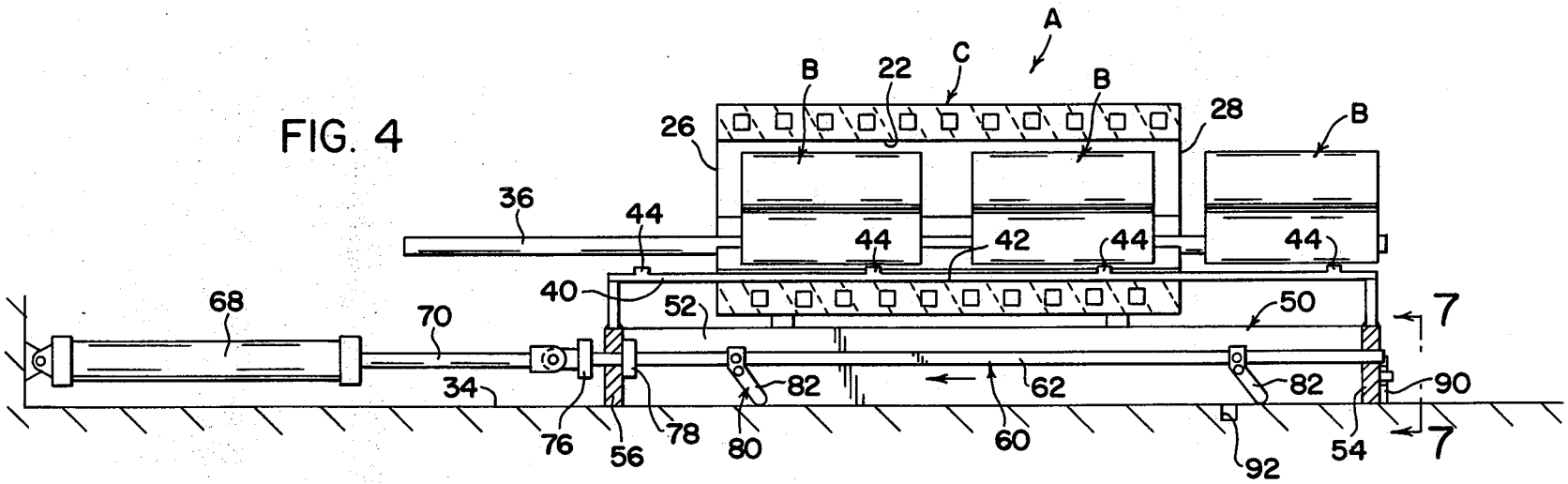
FIG. 4 is a view similar to FIG. 1 but showing instead the feeder mechanism at an intermediate stage in its return stroke.

In accordance with the present invention, there is provided a novel feeding mechanism F for supporting and conveying the workpieces B axially through the passage 20 from the entrant end 26 to the exit end 28 so that they are progressively heated to the desired forging temperature therein, generally in the range of from 1700° F.-2400° F. In accordance with the preferred embodiment of the invention, the feeding mechanism F includes a workpiece support or slide track means comprised of a pair of transversely spaced parallel support rails 36 extending longitudinally through the passage 20 of the heating coil unit C parallel to the axis a thereof. The slide rails 36 are preferably extended outwardly beyond the opposite ends of the heating coil unit C a distance exceeding the length of each workpiece so as to be capable of also supporting respective ones of the workpieces outside the heating coil passage 20 in an initial loading or feeding position opposite the entrant end 26 of and axially aligned with the passage 20 as shown in FIGS. 1 and 2, as well as in a discharge position opposite the exit end 28 of and axially aligned with the passage 20 as shown in FIGS. 3 and 4. The support rails 36 are fixedly supported in lower, spaced grooves 38 (FIG. 5) formed in the wall 22 of heating coil unit C and extending parallel to the axis a of the passage 20 therein. The rails 36 preferably are in the form of cylindrical cross-section rods and are made of a suitable high temperature resistant non-magnetic metal such as stainless steel, for example.

The feeding mechanism F further comprises a workpiece transfer means including an elongated workpiece-advancing driven member 40 in the form of a pusher rod or bar extending longitudinally through and preferably along the bottom of the passage 20 of the coil unit C in a direction parallel to the coil axis a. Like the support rails 36, the pusher rod 40 is also made of a high heat resistant non-magnetic metal such as stainless steel and it is received within and reciprocable through a longitudinal groove or guideway 42 formed in the wall 22 of the heating coil passage 20 (FIG. 5), preferably extending along the bottom thereof in the vertical plane of its axis a. The pusher rod 40 is reciprocated in its guide groove 42 alternately between a retracted position as shown in FIG. 1 and an advanced or extended position as shown in FIG. 3. On its advance stroke to its extended position, the pusher rod progressively pushes and slides the workpieces B forwardly in spaced relation along the support rails 36 in step-by-step fashion into and through the heating coil passage 20 to cause them to become heated to the desired processing temperature.

To enable it to thus push the workpieces B ahead along the support rails 36, the pusher rod 40 is provided, on its side facing the workpieces on the support rails 36 (the upper side in the particular case illustrated) with a plurality of workpiece-engaging driving lugs or abutment shoulders 44 spaced apart therealong a distance somewhat exceeding the length of the elongated workpieces. The pusher rod 40 is vertically shiftable, between a first or inoperative elevational position (a lowered position in the particular case illustrated in FIG. 1) in which the driving lugs 44 are spaced from and out of the path of travel of the workpieces along the support rails 36, and a second or operative elevational position (a raised position in the particular case illustrated in FIG. 2) in which the driving lugs 44 are located in the path of travel of the workpieces along the support rails 36. At the outset of its advance stroke from its retracted to its extended position, the pusher rod 40 is shifted to its second or operative elevational position and it is then maintained in such position during its advance stroke to cause the driving lugs 44 thereon to abut against and engage with the workpieces B on the support rails 36 to progressively push and slide them therealong in step-by-step fashion.

The pusher rod or driven member 40 of the workpiece feeder mechansim F is supported and carried at its opposite ends on, and is reciprocated by support means which, as shown, may comprise a horizontally disposed elongated support frame 50 of generally rectangular shape extending longitudinally of and transversely centered beneath the heating coil unit C. Support frame 50 is formed of a pair transversely spaced side bar members 52 connected together at their respective ends by front and rear end cross-bar members 54 and 56, respectively. The support frame 50 is vertically shiftable to vertically shift the pusher rod 40 between its raised and lowered elevational positions, as described above. In its lowered position as shown in FIG. 1, the support frame 50 rests on the upper surface 34 of support base 32.

The support frame 50 is reciprocated in a direction parallel to the axis a of the heating coil passage 20 and to the support rails 36 therein, to effect the reciprocation of the pusher rod 40 between its retracted and its extended positions, by an actuating slide means 60. This slide means comprises a pair of transversely spaced parallel actuating rods 62 located beneath the heating coil unit C and extending longitudinally through the support frame 50 parallel to the axis a of the coil passage 20 and to the support rails 36. The actuating rods 62 have a longitudinal sliding fit as indicated at 64 in the end cross-bar members 54, 56 of support frame 50 and are preferably formed of square or other non-circular cross-section so as to be nonrotatable in the support frame members 54, 56. The two actuating rods 62 are rigidly joined together at one end, e.g., at their rearward ends as shown, by a transversely extending horizontal cross tie rod 66 to form actuating slide means 60 as a unitary acutating rod slide assembly. The actuating rod slide means or assembly 60 is reciprocated by suitable power drive means such as a hydraulic cylinder 68 having a piston rod 70 projecting from one end and pivotally connected to the slide assembly by the tie rod 66 so as to pivot in a vertical plane parallel to the actuating rods 62. The hydraulic cylinder 68 extends generally longitudinally of the actuating slide assembly 60 and is pivotally supported at its other end, to likewise pivot in a vertical plane parallel to the actuating rods 62, on a pivot pin 72 carried by support bracket 74 upstanding from the support base 32.

Reciprocation of the support frame 50 by actuating slide rod assembly 60 to effect the reciprocation of the push rod 40 is produced by the abutting engagement of a pair of similar abutment shoulders or collars 76,78 on each actuating rod 62 with the rearward end cross-bar 56 of support frame 50, the two collars 76,78 on each actuating rod 62 being located for such purpose on opposite sides of end cross-bar member 56. The abutment collars 76,78 on each of the actuating rods 62 are preferably spaced apart therealong a distance d (FIG. 1) substantially exceeding the thickness of the end cross-bar member 56 so as to engage therewith, on each alternate advance and return stroke of slide rod assembly 60, only after an initial loss motion travel of the assembly 60 relative to the support frame 50, equal to the distance d, at the outset of each stroke. This lost motion travel of the actuating slide rod assembly 60 relative to support frame 50 thus provides, in effect, a lost motion reciprocation drive connection therebetween for a purpose as hereinafter described.

Figure 5:
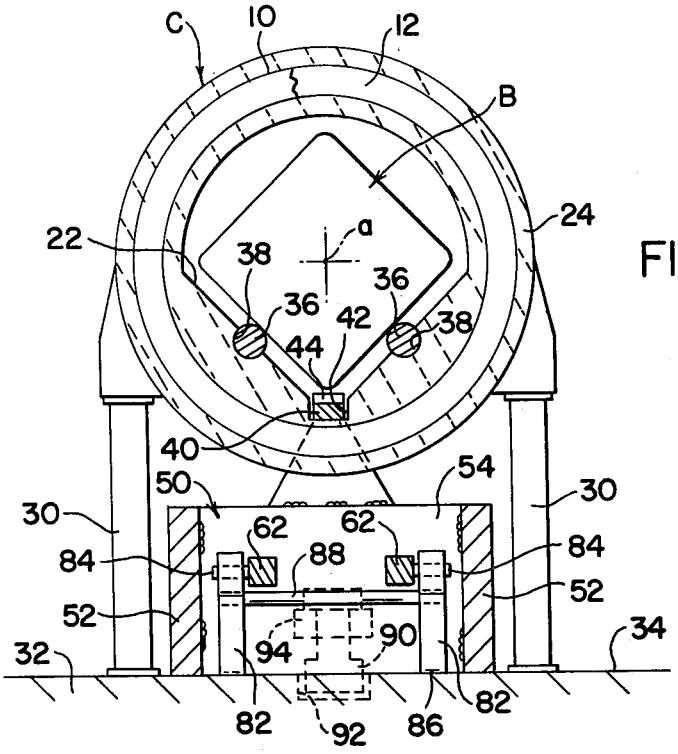
FIG. 5 is an enlarged transverse cross-sectional view on the line 5—5 of FIG. 1.

The vertical shifting of the pusher rod 40 as mentioned previously between its two different elevational positions in which the driving lugs 44 thereon are respectively located in and out of the path of sliding travel of the workpieces B along support rails 36, is produced by elevating means 80 acting in conjunction with the actuating rod slide assembly 60 and support frame 50. In the particular form of the invention illustrated wherein the pusher rod 40 extends beneath the workpieces on the support rails 36, the elevating means 80 in such case is arranged to shift the pusher rod between a lowered or inoperative elevational position (FIG. 1) in which its driving lugs 44 are out of, i.e., below, the path of sliding travel of the workpieces along support rails 36 and a raised or operative elevational position in which its driving lugs 44 are in the path of sliding travel of the workpieces along the support rails and in position for abutting engagement with the workpieces on subsequent advance movement of the pusher rod 40. The particular elevating means 80 illustrated comprises cam or throw arm means in the form of a pair of pivot arms 82 carried by each respective actuating rod 62 and pivoted at one end thereon, as by means of pivot pins 84, to swing freely in the vertical plane of the respective actuating rod and depend freely therefrom. As shown, the throw arms 82 on each actuating rod 62 are spaced a considerable distance apart and are preferably located within the support frame 50. The other or lower ends 86 of the throw arms 82 are rounded off in the vertical plane of the respective actuating rods 62 in the form of an arc of a circle for example, and they rest on the upper slide surface 34 of support base 32 and frictionally engage therewith during the forward stroke of the actuating rod slide assembly 60. Throw arms 82 are preferably arranged in transversely aligned groups or pairs on the actuating rods 62 and each pair rigidly joined together by a cross-tie rod 88 so as to pivot in unison about their respective pivot pins 62. As shown in FIG. 5, tie rods 88 extend beneath the actuating rods 62 and engage therewith to restrict rearward (i.e., clockwise in FIG. 2) pivotal movement of the throw arms 82 to, and prevent over-center pivoting thereof beyond, their upright position shown in FIG. 2. In the retracted position of the actuating slide rod assembly 60 as shown in FIG. 1, in which position the pusher rod 40 is in its lowered inoperative position and support frame 50 rests on support surface 34, the freely pivoted throw arms 82 on actuating rod 62 hang down therefrom in a forwardly declined, lowered pivoted position as determined by the resting engagement of the throw arms, at their rounded lowered ends 86, on the slide surface 34.

Figure 6:
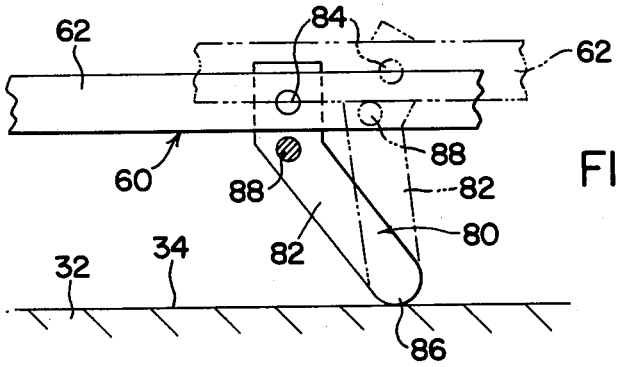
FIG. 6 is a fragmentary enlarged side elevation of the pusher rod elevating means of the feeder mechanism comprising the invention.
Figure 7:
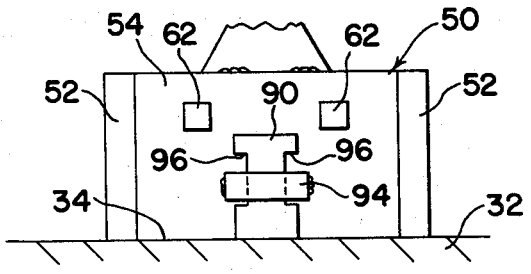
FIG. 7 is a fragmentary end elevation of the feeder mechanism comprising the invention showing the locking latch for the pusher rod carrier in its raised inoperative position as shown in FIGS. 2–4.

On the forward advance stroke of the actuating rod slide assembly 60, the throw arms 62, rather than being bodily carried along therewith and simply sliding along the surface 34, instead frictionally engage at their lower ends 86 with the slide surface 34 to cause them to be pivoted backwardly or clockwise, as shown by the arrow in FIG. 2, to their upright position as shown in FIG. 2 and in dash-dot lines in FIG. 6. This pivoting of throw arms 82 to their upright position occurs during the lost motion travel d of actuating rod slide assembly 60 relative to support frame 50, at the outset of the advance stroke of the slide assembly, and it operates to lift the actuating rod slide assembly 60 and the support frame and pusher rod 40 carried thereby, to their raised operative position in which the driving lugs 44 on the pusher rod are located in the path of sliding travel of the workpieces B along support rails 36, in position for abutting engagement with the workpieces during the subsequent advance stroke of the pusher rod. The slide surface 34 engaged by the throw arms 82 may be of suitably roughened character such as that formed for example, by knurling, by sand blasting, or by providing it with fine transversely extending serrations or grooves, to thereby assure the existence of sufficient frictional force between the engaged surfaces 86 and 34 of throw arms 82 and support base 32 to effect the pivoting of the throw arms to their upright position and lifting of the actuating rod slide assembly 60 along with the support frame 50 and pusher rod 40 to their raised operational elevational position during the lost motion travel d of the slide assembly 60 relative to support frame 50. During the pivoting of the throw arms 82 to their upright position, they are prevented from pivoting over-center or beyond their upright position by the engagement of their cross tie rods 88 with the undersides of the actuating rods 62, as shown in dotted lines in FIG. 6. Once the throw arms 82 are pivoted to their upright position as described above during the lost motion travel d of the actuating rod slide assembly 60 relative to support frame 50, they then are maintained in such upright position, and the support frame 50 and pusher rod 40 thus maintained in their raised operating elevational position, throughout the remainder of the advance stroke of actuating rod slide assembly 60 by the continuing frictional forces applied to the rounded lower ends 86 of throw arms 82 as they slide across the slide surface 34 while pressed thereagainst by the combined weight of the elevated actuating rod slide assembly 60, the support frame 50 and the pusher rod 40 which are then all carried and supported on the slide surface 34 by the upright throw arms 82.

A locking latch 90 is provided on support frame 50, preferably on the front end cross bar 54, for engaging and locking within a mating notch 92 in the upper surface 34 of support base 32 when the support frame is in its retracted position. The notch-engaged latch 90 locks the support frame 50 in place against any advance movement from its retracted position by the actuating rod slide assembly 60 until after the support frame 50 and pusher rod 40 are raised to their operative elevational position by the pivoting of throw arms 82 of elevating means 80. The lock latch 90 thus prevents the support frame 50 and pusher rod 40 from being carried along with the actuating rod slide assembly 60 at the outset of its advance stroke, and assures the lifting of support frame 50 and pusher rod 40 to their raised or operative elevational position during the lost motion travel d of slide assembly 60 relative to support frame 50 and before the start of any advance movement of the support frame and pusher rod toward their extended position by the slide assembly 60. The lifting of the support frame 50 by elevating means 80 causes the support frame to also lift the locking latch 90 out of engagement within the notch 92 (FIG. 2), thus freeing the support frame 50 for subsequent advance movement to its extended position by the actuating rod slide assembly. Latch 90 is supported on support frame 50 by, and vertically slidable in a saddle or slide block 94 fastened on the front end cross bar 54 of the support frame. The latch 90 is formed with a widened upper end to provide abutment shoulder portions 96 (FIG. 7) which are engaged by the saddle block 94, on the upward shifting of support frame 50 and pusher rod 40 to their raised operative elevational position, to lift the latch out of and disengage it from the notch 92 and thus free the support frame for advance movement by the actuating rod slide assembly 60. If desired, the latch 90 may be suitably spring biased in a downward direction to assure positive engagement within the notch 92.

At the end of the initial lost motion travel d of actuating rod slide assembly 60 on its advance stroke (shown by the horizontal arrow in FIG. 2) to vertically shift the pusher rod 40 and its support frame or carriage 50 and actuating rod slide assembly 60 to their raised operative elevational position as shown by the vertical arrow in FIG. 2, the abutment collars 76 on the slide assembly then abut against the rear end cross bar 56 of support frame 50 and push the then elevated support frame and pusher rod 40 forwardly to their advanced or extended position, as shown in FIG. 3, by the continued advance movement of the actuating rod slide assembly 60 through the remainder of its advance stroke. During this advance movement of the pusher rod 40, its driving lugs 44 abut against the rear ends of the respective workpieces B on support rails 36 (FIG. 3) and push them ahead thereon. As a result, the workpiece in the loading position on the support rails 36 opposite the entrant end 26 of the heating coil passage 20 is advanced into and located in its first heating position in the passage 20 while the workpiece in the second or last heating position in the passage 20 is pushed out the exit end 28 of the passage and advanced to its discharge position on the support rails 36, as shown in FIG. 3. The workpiece previously in the discharge position on the support rails 36 is at the same time pushed off the ends of the rails and thus discharged from the heating apparatus A.

After the advance of the workpieces B ahead on support rails 36 to their next succeeding positions thereon by the pusher rod 40 of the feeding mechanism F, the pusher rod is then returned to its retracted position, in readiness for the start of another cycle of operation, by the return stroke of hydraulic cylinder piston 70 and its associated actuating rod slide assembly 60. During the first part of this return stroke of the slide assembly 60, the pusher rod 40 and its support frame or carriage 50 remain in their fully extended position until the slide assembly 60 completes its lost motion return travel d and the abutment collars 78 thereon abut against the rear end cross bar 56 of the support frame to thereafter carry the support frame and pusher rod along with it back to their retracted position. At the very outset of and during the lost motion return travel d of the actuating rod slide assembly 60 on its return stroke, the frictional engagement of the then upright positioned throw arms 82 with the slide surface 34 acts to pivot or collapse them back to their declined or lowered position as shown in FIG. 4. This then vertically shifts the slide assembly 60 and support frame 50 and pusher rod 40 carried thereby back down to their original, lowered inoperative elevational position as determined by the resting re-engagement of the support frame with the slide surface 34, thus lowering the driving lugs 44 on pusher rod 40 out of, i.e. below, the path of travel of the workpieces along the support rails 36 so as to clear the workpieces on subsequent retraction of the pusher rod. The vertical shifting of the actuating rod slide assembly 60 and the associated support frame 50 and pusher rod 40 back to their lowered inoperative position also results in the locking latch 90 re-engaging at its lower end with and resting on the slide surface 34 to cause it to vertically slide upwardly relative to its saddle mounting block 94 and lift its abutment shoulder portions 96 off the saddle block. At the end of the lost motion return travel d of actuating rod slide assembly 60 on its return stroke shown by the arrow in FIG. 4, the abutment collars 78 on the slide assembly abut against the rear end cross bar 56 of support frame 50 and then push the lowered support frame and pusher rod 40 backwardly to their original retracted position shown in FIG. 1, in readiness for the start of another cycle of operation, by the continued return movement of the slide assembly 60 through the remainder of its return stroke. During this return movement of the support frame 50 and pusher rod 40 back to their original retracted position, the locking latch 90 rests of its own weight on and slides along the support surface 34. As a result, when the support frame 50 reaches its original retracted position, the locking latch 90 then vertically aligns with and falls freely of its own weight into the notch 92 in support surface 34, thus locking the support frame against any rectilinear movement longitudinally of the support rails 36.

It will be apparent that various modifications may be made in the feeding mechanism F disclosed herein without departing from the spirit and scope of the invention. For example, the pusher rod 40 may be arranged to extend through the passage 20 in the heating coil unit C in a position above the workpieces B on the support rails 36 instead of therebeneath as in the embodiment of the invention illustrated herein. With such a modified arrangement, the elevating means 80 must be arranged to first shift the pusher rod 40 vertically downward, during the first pair or lost motion travel d of the actuating rod slide assembly 60 on its advance stroke, from an initial raised inoperative elevational position with its driving lugs 44 located above and out of the path of travel of the workpieces along the support rails 36, to a lowered operative elevational position with its driving lugs 44 located in the path of travel of the workpieces along the support rails. Likewise, the elevating means 80 in such a modification must be arranged to shift the pusher rod 40 vertically upward, during the first part or lost motion travel d of the actuating rod slide assembly 60 on its return stroke, from its lowered operative elevational position back to its original raised inoperative elevational position. Such a modified manner of operation of the elevating means 80 would necessitate the reversal of the pivotal mounting of the throw arms 82 on the actuating rods 62 from that shown in FIGS. 1–4 and 6, i.e., the throw arms 82 would have to decline rearwardly from the actuating rods 62 instead of forwardly therefrom as in FIGS. 1–4 and 6 so that they would be in their declined lowered position during the advance stroke of the pusher rod 40 and in their upright raised position during the return stroke of the pusher rod. With this modification also, the notch 92 for the locking latch 90 would be located at the advanced position of the latch 90 and its support frame 50 instead of at their retracted position as in FIGS. 1–4.

As a further modification of the invention, the actuating rod means 60, in place of having a lost motion reciprocation drive sliding connection with the support frame 50, may be rigidly connected instead to the support frame so as to form a unitary structure and reciprocate as a unit therewith. Because the pusher rod 40 in such a modified arrangement is vertically shifted between its inoperative and operative elevational positions while it is at the same time being rectilinearly advanced and retracted by the actuating rod means 60, the driving lugs 44 on the pusher rod 40 must in such case be spaced apart a sufficient distance exceeding the length of the workpieces B to enable the lugs 44 to be positioned in and out of the path of travel of the workpieces on the support rails before they arrive abreast of the rear and forward ends, respectively of the workpieces on the advance and return strokes of the pusher rod 40.

Figure 8:
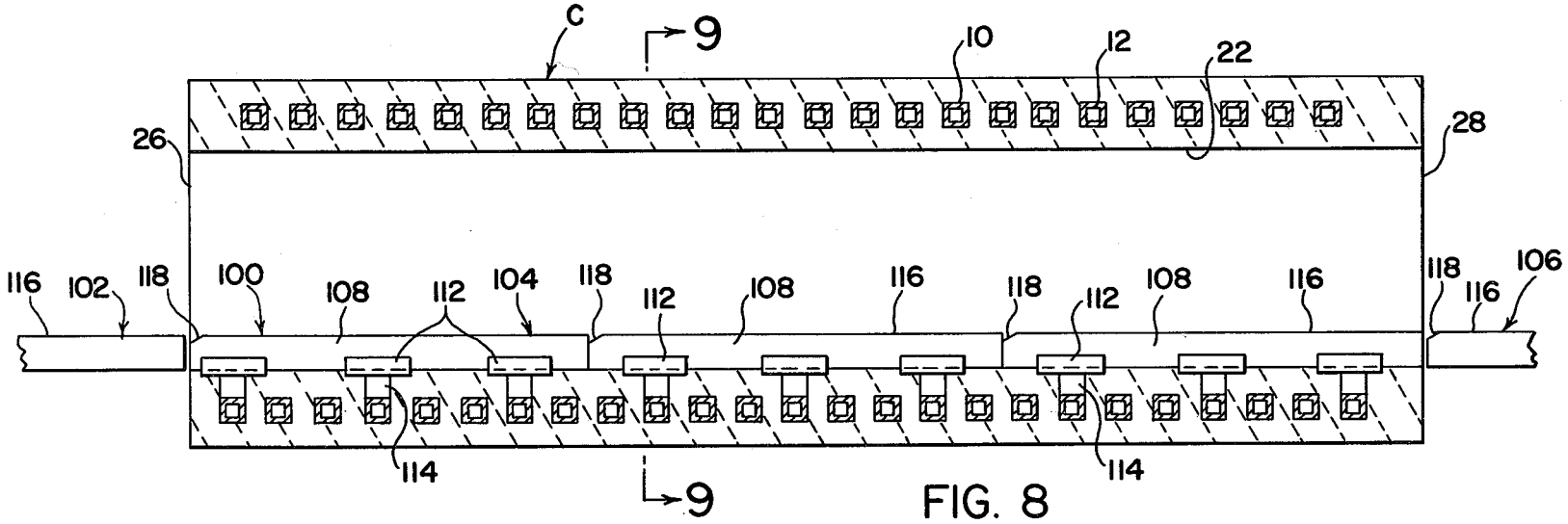
FIG. 8 is a longitudinal section, on the line 8-8 of FIG. 9, through the induction heating coil of a feeder mechanism comprising the invention having modified form of workpiece support rail in the heating coil passage; and, FIG. 9 is a transverse cross-sectional view on the line 9—9 of FIG. 8.
Figure 9:
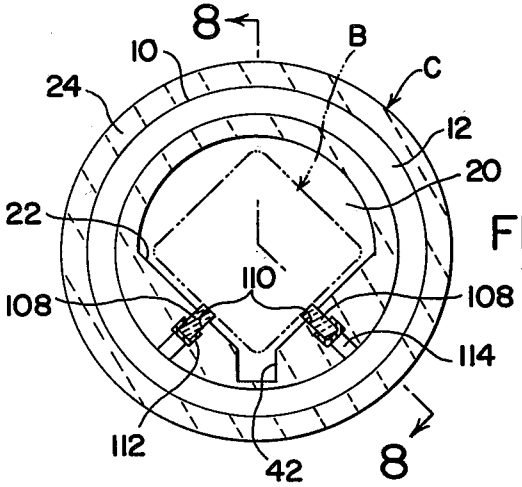

FIGS. 8 and 9 illustrate a modified form of slide track arrangement for conveying the workpieces B into and through the passage 20 of the induction heating coil C which affords convenient and economical replacement of any portions thereof that for any reason may require replacement such as because of heat distortion, for example. This modified slide track arrangement comprises a pair of transversely spaced parallel support rails 100 corresponding to support rails 36 and extending longitudinally through the heating coil passage 20 adjacent the bottom thereof. Each rail 100 is formed as a composite of a workpiece loading rail portion 102 located outside the heating coil passage 20 opposite its entrant end 26, a heating passage portion 104 located within and extending through the heating passage 20, and a workpiece discharge rail portion 106 located outside the passage 20 opposite its exit end 28. Rail portions 102 and 106 may be made of any suitable metal such as stainless steel for example, and they are suitably supported in place on the support base 32 as by means of mounting brackets (not shown). Rail portions 104 are each constituted by a series of separate elongated rail sections 108 of bar-like form and made of a suitable non-magnetic wear-resistant refractory material such as that commercially known as Diamonite, for instance. The rail sections 108 forming rail portions 104 are snugly received within respective longitudinally extending slots 110 formed in the wall 22 of passage 20, and they are each supported in the slot by a plurality (three in the particular case shown) of U-shaped metal inserts or shoes 112 molded into the refractory material 24 of the heating coil unit C within the slots 110. These supporting shoe inserts 112 are formed of a suitable non-magnetic metal such as copper, for example, and they are supported at their undersides of the convolutions 12 of the induction heating coil 10 by means of support posts 114 which rest on the coil convolutions and may also be made of copper. The workpiece-engaging upper or slide surfaces 116 of the rail sections 108 as well as of the discharge rail section 106 are all beveled at their trailing ends, as indicated at 118, to avoid the possibility of any upstanding catch shoulders being present at the rail joints extending above the slide surface 116 of the next preceding rail section, on which shoulders the workpieces could catch so as to interfere with their sliding travel smoothly along the support rails 102.

Should the support rail portions 104 within the heating coil passage 20 become damaged at any point or points therealong during the use of the heating apparatus such as to require their replacement, the damaged portion or portions are easily and quickly replaceable by simply withdrawing the damaged rail section 108 out of its mounting shoe inserts 112 and out of the slot 110, and reinserting a new or undamaged rail section 108 into the slot 110 and into the shoe inserts 112. With this modified support track arrangement 100, therefore, there is not need for replacing the entire length of any support rail 100 that may become damaged at one or more points along its total length, thus minimizing maintenance cost.

Having thus defined the invention, it is claimed:

1. A mechanism for feeding a succession of elongated workpieces having a given length axially along a given path through an elongated workpiece receiving passage of a multiturn induction heating coil, said mechanism comprising: slide rail means fixedly positioned within and extending axially through said passage for supporting the said workpieces thereon for sliding advance movement therealong through said passage; a driven member extending longitudinally through and reciprocable axially of said passage and having at least two driving lugs spaced axially of said passage a distance exceeding said given length for engaging the workpieces resting on said slide rail means and slidably pushing them forwardly therealong in spaced relation to one another on the advance reciprocation stroke of said driven member; elevating means for selectively shifting said driven member between a first elevational position with said driving lugs spaced from said path and a second elevational position with said driving lugs in said path; and actuating rod means connected to and actuating both said driven member and said elevating means and reciprocable through alternate advance and return strokes for reciprocating said driven member axially of said passage between a first retracted position and a second extended position; said elevating means including cam means actuated by said actuating rod means for shifting said driven member from said first elevational position into said second elevational position during the initial portion of the said advance stroke of said power drive means to shift said driven member from said retracted position to said extended position and for shifting said driven member back into said first elevational position during the initial portion of the said return stroke of said power drive means.

2. A mechanism as defined in claim 1 wherein said actuating rod means is connected to said driven member by a lost motion connection and actuates said cam means, during the lost motion travel of said actuating rod means relative to said driven member at the outset of said advance and return strokes of said actuating rod means, to shift the said driven member between said first and second elevational positions during the said lost motion travel of said actuating rod means.

3. A mechanism as defined in claim 1 wherein said driven member is located beneath the workpiece supported on said support means, with the said driving lugs spaced below said path when said driven member is in its said first elevational position and said driving lugs located in said path when said driven member is in its said second elevational position.

4. A mechanism as defined in claim 2 wherein said driven member is located beneath the workpiece supported on said support means, with the said driving lugs spaced below said path when said driven member is in its said first elevational position and said driving lugs located in said path when said driven member is in its said second elevational position.

5. A mechanism as specified in claim 1 wherein the said actuating rod means extends parallel to and is connected with said driven member externally of said passage, and wherein said cam means include throw arm means, said throw arm means being pivoted at one end on said actuating rod means and alternately pivoting between a declined lowered and a substantially upright raised position, at the outset of the said advance and return strokes of said actuating rod means, to shift the said driven member alternately between said first and second elevational positions.

6. A mechanism as defined in claim 5 wherein said driven member is carried by said actuating rod means.

7. A mechanism a defined in claim 5 wherein said power drive means includes a hydraulic cylinder connected to said actuating rod means to reciprocate it.

8. A mechanism for feeding a succession of elongated workpieces having a given length axially along a given path through an elongated workpiece receiving passage of a multiturn induction heating coil and along workpiece support means extending axially in said passage, said mechanism comprising: a driven member extending longitudinally through said passage and having at least two driving lugs spaced axially of said passage a distance exceeding said given length; elevating means for selectively shifting said driven member between a first elevational position with said driving lugs spaced from said path and a second elevational position with said driving lugs in said path; and power drive means connected to said driven member and reciprocable through alternate advance and return strokes for reciprocating said driven member axially of said passage between a first retracted position and a second extended position; said elevating means including cam means for shifting said driven member from said first elevational position into said second elevational position, during the initial portion of the said advance stroke of said power drive means, to shift said driven member from said retracted position to said extended position and for shifting said driven member back into said first elevational position during the initial portion of said return stroke of said power drive means, said power drive means being connected to said driven member by a lost motion connection and actuating said cam means, during the lost motion travel of said power drive means relative to said driven member at the outset of said advance and return strokes of said power drive means, to shift the said driven member between said first and second elevational positions during the said lost motion travel of said power drive means, said power drive means comprising actuating rod means extending parallel to and connected through said lost motion connection with said driven member, and said cam means including throw arms each of which is pivoted at one end on said actuating rod means and alternately pivots between a declined lowered and a substantially upright raised position, at the outset of the said advance and return strokes of said power drive means, to shift the said driven member alternately between said first and second elevational positions.

9. A mechanism for feeding a succession of elongated workpieces having a given length axially along a given path through an elongated workpiece receiving passage of a multiturn induction heating coil and along workpiece support means extending axially in said passage, said mechanism comprising: a driven member extending longitudinally through said passage and having at least two driving lugs spaced axially of said passage a distance exceeding said given length; elevating means for selectively shifting said driven member between a first elevational position with said driving lugs spaced from said path and a second elevational position with said driving lugs in said path; and power drive means connected to said driven member and reciprocable through alternate advance and return strokes for reciprocating said driven member axially of said passage between a first retracted position and a second extended position; said elevating means including cam means for shifting said driven member from said first elevational position into said second elevational position, during the initial portion of the said advance stroke of said power drive means, to shift said driven member from said retracted position to said extended position and for shifting said driven member back into said first elevational position during the initial portion of the said return stroke of said power drive means, said power drive means comprising actuating rod means extending parallel to and connected with said driven member externally of said passage, and said cam means including throw arm means pivoted at one end on said actuating rod means and alternately pivoting between a declined lowered position and a substantially upright raised position, at the outset of the said advance and return strokes of said power drive means, to shift the said driven member alternately between said first and second elevational positions, said power drive means including a support frame located externally of said passage and carrying said driven member, and said actuating rod means being reciprocably mounted in and carrying said support frame.

10. A mechanism as defined in claim 9 wherein said actuating rod means has a lost motion reciprocating drive connection with said support frame and actuates said cam means, during the lost motion travel of said actuating rod means at the outset of said advance and return strokes of said actuating rod means, to shift the said support frame and said driven member between said first and second elevational positions.

11. A mechanism as defined in claim 10 wherein said lost motion connection comprises a pair of abutment shoulders on said actuating rod means spaced a predetermined distance apart therealong and located on opposite sides of and engageable with a portion of said support frame within which said actuating rod means is reciprocably mounted.

12. A mechanism as defined in claim 9 wherein said actuating rod means comprises a plurality of transversely spaced parallel actuating rods interconnected to reciprocate in unison, each of said actuating rods carrying a plurality of said throw arm means pivoted at one end thereon at spaced points therealong and supporting said support frame in place when elevated by said throw arm means.

13. A mechanism for feeding a succession of elongated workpieces having a given length axially along a given path through an elongated workpiece receiving passage of a multiturn induction heating coil and along workpiece support means extending axially in said passage, said mechanism comprising: a driven member extending longitudinally through said passage and having at least two driving lugs spaced axially of said passage a distance exceeding said given length; elevating means for selectively shifting said driven member between a first elevational position with said driving lugs spaced from said path and a second elevational position with said driving lugs in said path; and power drive means connected to said driven member and reciprocable through alternate advance and return strokes for reciprocating said driven member axially of said passage between a first retracted position and a second extended position; said elevating means including cam means for shifting said driven member from said first elevational position into said second elevational position, during the initial portion of the said advance stroke of said power drive means, to shift said driven member from said retracted position to said extended position and for shifting said driven member back into said first elevational position during the initial portion of the said return stroke of said power drive means, said power drive means comprising actuating rod means extending parallel to and connected with said driven member externally of said passage, and said cam means including throw arm means pivoted at one end on said actuating rod means and alternately pivoting between a declined lowered position and a substantially upright raised position, at the outset of the said advance and return strokes of said power drive means, to shift the said driven member alternately between said first and second elevational positions, said heating coil being mounted on a support base having a substantially flat horizontal upper slide surface disposed below said coil and extending parallel to said path, and said pivoted throw arms having free ends spaced from said actuating rod means, said throw arm means being freely suspended from said actuating rod means and frictionally engaging at their free ends with and sliding along the said slide surface, on the advance stroke of said power drive means, to initially pivot said throw arm means from their said declined lower position to their said substantialy upright raised position and thereby lift the said driven member to the raised one of its said elevational positions.

14. A mechanism as defined in claim 13 wherein said support frame rests on said support base when the said throw arm means are in their said declined lower position.

15. A mechanism as defined in claim 13 wherein the said slide surface of said support base is of roughened form to provide a relatively high coefficient of sliding friction between the said surface and the ends of the said pivoted throw arm means frictionally engaged therewith.

16. A mechanism as defined in claim 13 wherein said throw arm means are provided with stop means engageable with said actuating rod means, during the said advance stroke of said power drive means, to limit the said pivoting of said throw are means and lifting of said driven member to a predetermined amount and prevent overpivoting of said throw arm means beyond their said upright position.

17. A mechanism as defined in claim 10 wherein said heating coil is mounted on a support base having a substantially flat horizontal upper slide surface and is provided with a latching notch, and said support frame carries a locking latch member vertically reciprocable thereon and slidable along said slide surface and engageable within said notch to maintain said support frame and driven member in their said retracted position, during the said lost motion portion of the advance stroke of said actuating rod means, until elevated by said elevating means to the raised one of their said elevational positions and the said latch member lifted by said support frame out of engagement within said notch to free said latch member therefrom and permit advance movement of said latch member and said support frame and driven member to their said extended position by the continued advance stroke travel of said actuating rod means.

18. A mechanism as defined in claim 12 wherein said plurality of throw arm means are arranged on said plurality of actuating rods in a plurality of transversely aligned groups, and wherein the throw arm means of each said group are interconnected by cross tie rod means so as to pivot in unison, said tie rod means also forming stop means engageable with said actuating rods to limit the said pivoting of said throw arm means and lifting of said driven member to a predetermined amount and prevent over-center pivoting of said throw arm means beyond their said upright position.

19. A mechanism for feeding a succession of elongated workpieces having a given length axially along a given path through an elongated workpiece receiving passage of a multiturn induction heating coil and along a support slide track extending axially through and outwardly beyond the ends of said passage, means fixedly mounting said coil on a support base having a substantially flat horizontal upper surface disposed below said coil and extending approximately parallel to said slide track, an elongated pusher member extending longitudinally through and outwardly beyond the ends of said passage, said pusher member having a plurality of driving legs spaced axially of said passage a distance exceeding said given length for abutting engagement with said workpieces to push them along said slide track, transfer means externally of said heating coil and connected to the opposite ends of said pusher member for reciprocating it axially of said passage between a first retracted position and a second extended position to push the workpieces along said slide track in step-by-step manner, said transfer means including actuating rod means extending generally parallel to said pusher member and power drive means connected to said actuating rod means for reciprocating it through alternate advance and return strokes, and elevating means including throw arm members on said actuating rod means frictionally engageable with said flat upper surface for shifting said pusher member between a first elevational position with said driving lugs spaced from said path and a second elevational position with said driving lugs in said path during the initial portion of the said advance stroke of said actuating rod means to shift said pusher member from said retracted position to said extended position, and for shifting said pusher member back into said first elevational position during the initial portion of the return stroke of said actuating rod means to shift said pusher member from said extended position to said retracted position.

20. A mechanism is defined in claim 19 wherein said actuating rod means is connected to said pusher member by a slot motion connection and actuates said throw arm means, during the lost motion travel of said actuating rod means relative to said pusher member at the outset of said advance and return strokes of said actuating rod means, to shift the said pusher member between its said first and second elevational positions during the said lost motion travel of said actuating rod means.

21. A mechanism as defined in claim 19 wherein said pusher member underlies the workpieces on said slide track and is shifted from a lowered said first elevational position to a raised said second elevational position by said elevating means.

* * * * *